United States Patent [19]

Shaw

[11] Patent Number: 4,899,555

[45] Date of Patent: Feb. 13, 1990

[54] EVAPORATOR FEED SYSTEM WITH FLASH COOLED MOTOR

[75] Inventor: David N. Shaw, Manlius, N.Y.

[73] Assignee: Carrier Corporation, Syracuse, N.Y.

[21] Appl. No.: 353,981

[22] Filed: May 19, 1989

[51] Int. Cl.[4] ..... F25B 31/00

[52] U.S. Cl. ..... 62/505; 62/513

[58] Field of Search ..... 62/113, 505, 513

[56] References Cited

U.S. PATENT DOCUMENTS 3,232,074 2/1966 Weller et al. ..... 62/505
3,838,581 10/1974 Endress ..... 62/505
3,851,494 12/1974 Hess ..... 62/505
3,859,815 1/1975 Kasahara ..... 62/505
4,062,199 12/1977 Kasahara et al. ..... 62/505
4,254,637 3/1981 Brauch et al. ..... 62/505

*Primary Examiner*—Ronald C. Capossela
*Attorney, Agent, or Firm*—David J. Zobkiw

[57] ABSTRACT

Gaseous refrigerant is supplied from a flash tank economizer to cool the motor of a hermetic or semi-hermetic compressor when there is a sufficient flow available. When the flow becomes too small, liquid refrigerant is supplied to the shell of the compressor for cooling the motor.

4 Claims, 2 Drawing Sheets

EVAPORATOR FEED SYSTEM WITH FLASH COOLED MOTOR

BACKGROUND OF THE INVENTION

It is common practice to cool the motor of a compressor in a refrigeration system with refrigerant from the refrigeration system. The refrigerant can pass over, and thereby cool, the motor as part of the suction path. This will reduce the mass flow since the gas being drawn into the suction inlet of the compressor will be heated and therefore less dense. An alternative approach is to bypass a portion of the liquid refrigerant from a point upstream of the evaporator thereby utilizing refrigerant having more cooling capacity for cooling the motor and reducing the loss of mass flow.

SUMMARY OF THE INVENTION

In a positive displacement, economized refrigeration system, the refrigerant flow used for cooling the motor can take alternative paths. When the proper pressure exists in the flash tank economizer, gaseous refrigerant passes from the flash tank economizer through a pressure regulator into the shell to cool the motor. When the pressure in the flash tank economizer drops sufficiently, the pressure regulator controlling flow from the economizer to the shell closes and a valve is opened in a line which is connected at a point downstream of the economizer and bypasses the pressure regulator. Liquid refrigerant is then able to flow into the shell and flash cool the motor.

It is an object of this invention to provide adequate motor cooling under all operating conditions.

It is another object of this invention to eliminate the need for shell and tube economizers of the sensible heat transfer type.

It is an additional object to properly control an economizer flash tank.

It is a further object of this invention to provide a control system which is suitable for flooded as well as direct expansion evaporators. These objects, and others as will become apparent hereinafter, are accomplished by the present invention.

Basically, gaseous refrigerant flows from the flash tank economizer through a pressure regulator into the shell for cooling the motor when there is a sufficient pressure differential. Where the pressure differential is too low, as under a light load, the pressure regulator closes and a valve is opened in a line extending from a point downstream of the economizer to the shell whereby liquid refrigerant is supplied to the shell to flash cool the motor.

BRIEF DESCRIPTION OF THE DRAWINGS

For a fuller understanding of the present invention, reference should now be made to the following detailed description thereof taken in conjunction with the accompanying drawing wherein.

DESCRIPTION OF THE PREFERRED EMBODIMENTS

Figure 1:
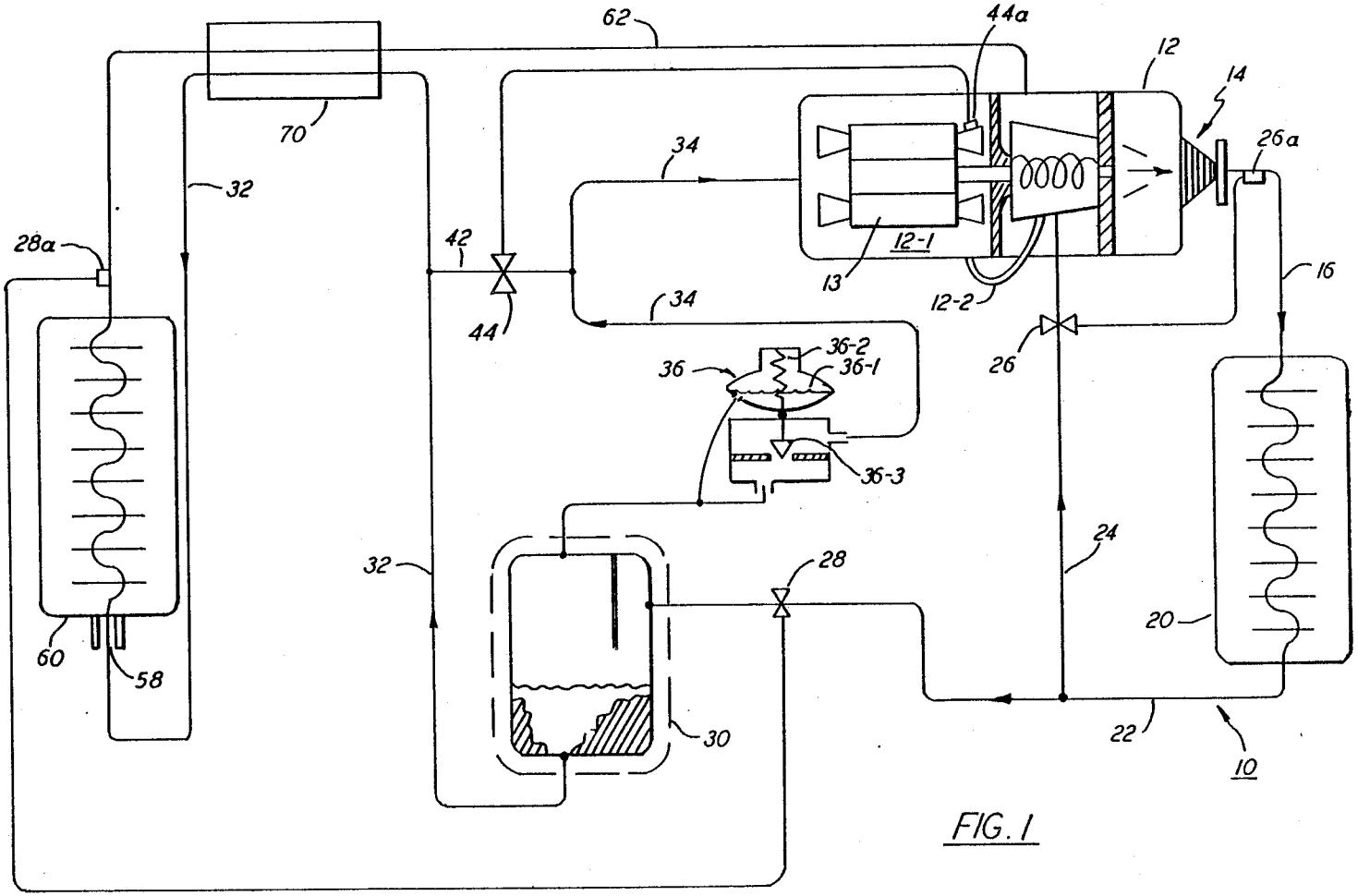
FIG. 1 is a schematic representation of a refrigeration system employing the present invention.

In FIG. 1, the numeral 10 generally designates a refrigeration system employing the present invention.

As illustrated, the numeral 12 generally designates a hermetic, intermediate pressure, horizontal screw compressor but the present invention is applicable to all positive displacement economized refrigeration systems. Compressor 12 is connected to air or water condenser 20 via discharge check valve 14 and discharge line 16. Condenser 20 may include a receiver and is connected to flash tank economizer 30 via line 22 which contains thermostatic expansion device 28. The lower portion of flash tank economizer 30 is connected via line 32, heat exchanger 70 and fixed restrictor 58 to direct expansion evaporator 60. Evaporator 60 is connected to the suction inlet (not illustrated) of compressor 12 via line 62 and heat exchanger 70.

Figure 2:
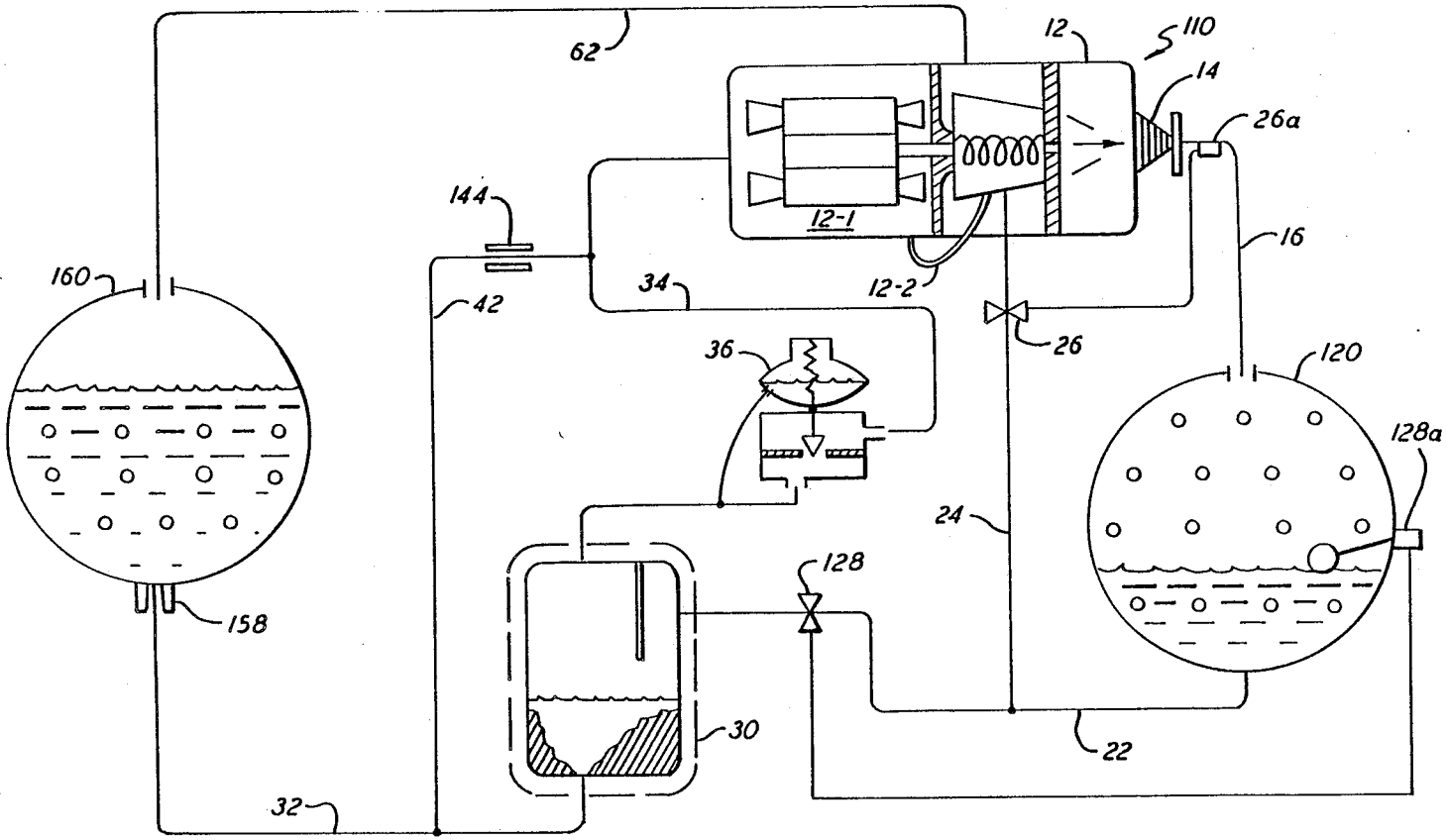
FIG. 2 is a schematic representation of a refrigeration system employing a modified embodiment of the present invention.

At a point upstream of thermostatic expansion device 28, line 22 is connected to the rotor housing of compressor 12 via line 24 which contains valve 26. Valve 26 may be a thermal expansion valve where **26*a* is a bulb at the outlet of compressor 12, an on-off solenoid connected where 26*a* is a thermostat, or any suitable electronically modulated control valve. The upper portion of flash tank economizer 30 is connected to chamber 12-1 in the interior of the shell of compressor via line 34 which contains upstream pressure regulator 36. Line 32 is connected to line 34 at a point downstream of upstream pressure regulator 36 by line 42 which contains electronically controlled valve 44 which is responsive to motor temperature sensor 44a but an orifice may be used, as illustrated in FIG. 2, which would eliminate the need for sensor 44a. A suction/liquid heat exchanger 70 will ordinarily be provided to exchange heat between lines 32 and 62**.

Under full load at design conditions, refrigerant will serially pass from compressor 12 through discharge check valve 14 into line 16 and through line 16 into condenser 20 where the hot, high pressure refrigerant is liquified. The liquid refrigerant is then supplied to line 22 with a portion sometimes passing through line 24 and valve 26, responsive to the temperature sensed by bulb 26a, into the rotor housing of compressor 12 where it serves to cool the oil. The rest of the liquid refrigerant supplied to line 22 passes through thermostatic expansion device 28 which drops the pressure of the refrigerant causing a portion of the refrigerant to flash in flash tank economizer 30. Thermostatic expansion valve 28 is controlled responsive to the superheat or quality of the refrigerant vapor leaving evaporator 60 as sensed by sensor 28a. Sensor 28a may be a bulb for sensing superheat or a hot wire anemometer type of device for sensing quality through temperature changes caused by the evaporation of impinging liquid refrigerant. Upstream pressure regulator 36 is open when the pressure in flash tank economizer 30 exceeds the suction pressure by a predetermined amount and will, therefore, be fully open at full load to thereby permit gaseous refrigerant to flow via line 34 into the chamber 12-1 in the shell of compressor 12 to cool the motor 13. Chamber 12-1, under normal conditions, is at essentially the same pressure as economizer 30. Liquid refrigerant flows from flash tank economizer 30 via line 32, heat exchanger 70 and fixed restrictor 58 into evaporator 60. Valve 44 will be closed at this time so there will be no flow in line 42. The refrigerant passing through restrictor 58 into evaporator 60 will evaporate and pass from evaporator 60 via line 62 into the suction inlet (not illustrated) of compressor 12. In lines 32 and 62, there will be a suction/liquid heat exchanger 70 to further cool the liquid refrigerant flowing to restrictor 58. Under the above described conditions upstream pressure regulator 36 is fully open so that the only functioning valve in the sense of active flow modulation is expansion device 28 which is controlled by sensor 28*a* responsive to the superheat or quality of the refrigerant leaving evaporator 60. At design, there should be slightly superheated vapor in line 62 between evaporator 60 and heat exchanger 70.

Assuming now that the cooling demand is reduced, the compressor 12 will unload causing the superheat to fall because thermostatic expansion device 28 is wide open. The thermostatic expansion device 28 responds to the decrease in superheat or quality sensed by sensor 28*a* and starts to close so less refrigerant enters flash tank economizer 30 and the pressure therein falls, and continues to fall, until upstream pressure regulator 36 checks it by throttling the flow. Thus, the only time there is sufficient pressure in economizer 30 is if there is a sufficient mass flow or head pressure. Referring to pressure regulator 36, the pressure in line 34 upstream of pressure regulator 36 acts on one side of diaphragm 36-1 as an opening force in opposition to the bias of spring 36-2. When the pressure from line 34 acting on diaphragm 36-1 is sufficient to overcome the bias of spring 36-2, valve 36-3 is open and the flow is through line 34. Refrigerant can still flow from the flash tank economizer 30 to compressor 12 but there is a problem if there is too low of a flow through upstream pressure regulator 36 resulting in insufficient cooling of motor 13. This problem is solved by the present invention. If an orifice was used in place of valve 44, as illustrated in FIG. 2, and upstream pressure regulator 36 was fully open, there would be no differential pressure across the orifice and therefore no significant flow through line 42. As the flow through the upstream pressure regulator 36 drops, a pressure differential will be established across the orifice 144 and create a secondary expansion point but the flow regulation will be that of a fixed orifice which may suffice in some applications. However, according to a preferred embodiment of the present invention, an electronically controlled valve 44 is actuated responsive to the motor temperature sensed by bulb 44*a* although it might be responsive to the gas temperature leaving the motor 13 due to the closing of upstream pressure regulator 36 under light load. When bulb 44a senses an increase in the temperature of motor 13 due to the closing of pressure regulator 36 and the resultant cutting off of the flow of gaseous refrigerant for cooling, valve 44 is opened permitting liquid refrigerant from line 32 to flow through lines 42 and 34 into the housing of compressor 12 where the refrigerant flashes and thereby cools motor 13. The liquid and gaseous refrigerant used for cooling motor 13 is separated from the suction gas and must pass from chamber 12-1 via line 12-2 to be injected into the rotor housing economizer injection port (not illustrated) after the refrigerant has provided a cooling function to motor 13. The injection takes place after the compression process has started and is a function of the mass flow that can take place through line 12-2 and the energy added in chamber 12-1. As a result, the cooling of the motor 13 is assured under all operating conditions and a shell and tube economizer is not required. The result is that flash tank economizer is used but is properly controlled and motor cooling remains satisfactory.

Referring now to FIG. 2 where the numeral 110 generally designates a refrigeration system employing a modified embodiment of the present invention. The embodiment of FIG. 2 differs from that of FIG. 1 as follows: (1) sensor 44*a* has been eliminated; (2) valve 44 has been replaced by fixed orifice 144; (3) condenser 20 has been replaced by shell and tube type condenser 120; (4) expansion device or valve 28 and sensor 28a have been replaced by expansion device or valve 128 which is responsive to liquid level sensor 128*a*; (5) the heat exchanger 70 is eliminated; and (6) evaporator 60 has been replaced by flooded evaporator 160 which is fed via fixed orifice 158. The operation of system 110 will be essentially the same as that of system 10 except that expansion device or valve 128 is responsive to the liquid level sensed in condenser 120 by sensor 128*a* and in that flow through line 42 and orifice 144 is responsive to a pressure differential caused by the the closing of pressure regulator 36.

Although preferred embodiments of the present invention have been illustrated and described, other changes will occur to those skilled in the art. It is therefore intended that the present invention is to be limited only by the scope of the appended claims.

What is Claimed is:

1. An economized refrigeration system comprising:

a positive displacement, hermetic compressor means having a motor therein and having inlet means including a plurality of inlets and an outlet;

condenser means connected to said outlet via a first fluid flow path means;

economizer means connected to said condenser means via a second fluid flow path means containing an expansion device;

a third fluid flow path means containing a pressure regulator means and connecting said economizer means to said inlet means for supplying gaseous refrigerant to said compressor means for cooling said motor means when said economizer means generates sufficient vapor flow;

a fourth fluid flow path means connecting said economizer means to an evaporator means for supplying liquid refrigerant from said economizer means to said evaporator means;

a fifth fluid flow path means connecting said evaporator means to said inlet means; and a sixth fluid flow path means containing valve means connecting said fourth fluid flow path means to said inlet means for supplying liquid refrigerant for cooling said motor means when said pressure regulator means is passing insufficient flow for cooling said motor means.

2. The refrigeration system of claim 1 wherein said valve means is opened responsive to said motor reaching a predetermined temperature.

3. An economized refrigeration system comprising:

a positive displacement, hermetic compressor means having a motor therein and having a plurality of inlets and an outlet;

condenser means connected to said outlet via a first fluid flow path means;

economizer means connected to said condenser means via a second fluid flow path means containing an expansion device;

a third fluid flow path means containing a pressure regulator means and connecting said economizer means to a first one of said plurality of inlets for supplying gaseous refrigerant to said compressor means for cooling said motor means when said economizer means generates sufficient vapor flow;

a fourth fluid flow path means connecting said economizer means to an evaporator means for supplying liquid refrigerant from said economizer means to said evaporator means;

a fifth fluid flow path means connecting said evaporator means to a second of said plurality of inlets; and a sixth fluid flow path means containing valve means connecting said fourth fluid flow path means to said first one of said plurality of inlets for supplying liquid refrigerant for cooling said motor means when said pressure regulator means is passing insufficient flow for cooling said motor means.

4. An economized refrigeration system comprising:

a positive displacement, hermetic compressor means having a motor therein and having inlet means including a plurality of inlets and an outlet;

condenser means connected to said outlet via a first fluid flow path means;

economizer means connected to said condenser means via a second fluid flow path means containing an expansion device;

a third fluid flow path means containing a pressure regulator means and connecting said economizer means to said inlet means for supplying gaseous refrigerant to said compressor means for cooling said motor means when said economizer means generates sufficient vapor flow;

a fourth fluid flow path means connecting said economizer means to an evaporator means for supplying liquid refrigerant from said economizer means to said evaporator means;

a fifth fluid flow path means connecting said evaporator means to said inlet means; and a sixth fluid flow path means containing orifice means connecting said fourth fluid flow path means to said inlet means for supplying liquid refrigerant for cooling said motor means when said pressure regulator means is passing insufficient flow for cooling said motor means.

* * * * *